US008664591B2

(12) United States Patent
Newton

(10) Patent No.: US 8,664,591 B2
(45) Date of Patent: Mar. 4, 2014

(54) ADJUSTING ENERGY OF IONS EJECTED FROM ION TRAP

(71) Applicant: Agilent Technologies, Inc., Loveland, CO (US)

(72) Inventor: Kenneth Newton, Loveland, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 13/833,785

(22) Filed: Mar. 15, 2013

(65) Prior Publication Data

US 2014/0034825 A1 Feb. 6, 2014

Related U.S. Application Data

(60) Provisional application No. 61/677,945, filed on Jul. 31, 2012.

(51) Int. Cl.
*H01J 49/42* (2006.01)
*H01J 49/26* (2006.01)

(52) U.S. Cl.
USPC ..... 250/283; 250/293; 250/396 R

(58) Field of Classification Search
USPC ..... 250/281–283, 286–288, 290–296, 396 R
See application file for complete search history.

(56) References Cited

U.S. PATENT DOCUMENTS

| | | | | |
|---|---|---|---|---|
| 5,714,755 | A * | 2/1998 | Wells et al. | 250/281 |
| 6,069,355 | A * | 5/2000 | Mordehai | 250/281 |
| 6,107,628 | A | 8/2000 | Smith et al. | |
| 6,583,408 | B2 | 6/2003 | Smith et al. | |
| 7,064,322 | B2 | 6/2006 | Crawford et al. | |
| 7,323,683 | B2 | 1/2008 | Krutchinsky et al. | |
| 7,378,653 | B2 * | 5/2008 | Wells | 250/292 |
| 7,495,212 | B2 | 2/2009 | Kim et al. | |
| 7,851,752 | B2 | 12/2010 | Kim et al. | |
| 7,888,635 | B2 | 2/2011 | Belov et al. | |
| 8,158,934 | B2 * | 4/2012 | Wells | 250/288 |
| 8,164,053 | B2 * | 4/2012 | Sugiyama et al. | 250/282 |
| 8,173,976 | B2 * | 5/2012 | Egley et al. | 250/492.1 |
| 8,299,421 | B2 * | 10/2012 | Wells | 250/281 |
| 2007/0158550 | A1 * | 7/2007 | Wells | 250/292 |
| 2008/0185511 | A1 * | 8/2008 | Senko | 250/283 |
| 2009/0032697 | A1 * | 2/2009 | Sugiyama et al. | 250/282 |
| 2011/0016700 | A1 * | 1/2011 | Egley et al. | 29/592.1 |
| 2011/0049347 | A1 * | 3/2011 | Wells | 250/282 |
| 2013/0248702 | A1 * | 9/2013 | Makarov | 250/282 |

OTHER PUBLICATIONS

Sunnie Myung et al.; High-capacity ion trap coupled to a time-of-flight mass spectrometer for comprehensive linked scans with no scanning losses; International Journal of Mass Spectrometry 301; 2011; pp. 211-219.

* cited by examiner

*Primary Examiner* — Bernard E Souw

(57) ABSTRACT

An ion trap includes a trap exit at which an ion energy adjusting device is located. The adjusting device may be configured for focusing a beam of ions ejected from the trap, reducing the energy distribution of the ions, and/or reducing the average kinetic energy of the ions. The adjusting device may include lenses to which RF and/or DC voltages are applied.

20 Claims, 7 Drawing Sheets

ADJUSTING ENERGY OF IONS EJECTED FROM ION TRAP

RELATED APPLICATIONS

This application claims the benefit of U.S. Provisional Patent Application Ser. No. 61/677,945, filed Jul. 31, 2012, titled "SYSTEMS AND METHODS FOR MS-MS ANALYSIS," the content of which is incorporated by reference herein in its entirety.

TECHNICAL FIELD

The present invention relates generally to ion traps and related systems such as mass spectrometry (MS) systems, and in particular relates to adjusting the energies of ions ejected from an ion trap.

BACKGROUND

A mass spectrometry (MS) system in general includes an ion source for ionizing components of a sample of interest, a mass analyzer for separating the ions based on their differing mass-to-charge ratios (or m/z ratios, or more simply "masses"), an ion detector for counting the separated ions, and electronics for processing output signals from the ion detector as needed to produce a user-interpretable mass spectrum. Typically, the mass spectrum is a series of peaks indicative of the relative abundances of detected ions as a function of their m/z ratios. The mass spectrum may be utilized to determine the molecular structures of components of the sample, thereby enabling the sample to be qualitatively and quantitatively characterized.

To elucidate additional information regarding a sample, the MS system may be configured for carrying out tandem MS, or MS-MS, experiments. In this case, selected ions produced by the ion source, or "parent" ions, are dissociated into fragment ions (or "daughter" ions) in a collision cell. Parent ions not dissociated in the collision cell as well as fragment ions may then be transmitted into the mass analyzer to produce mass spectra. Tandem MS may be implemented in a triple quadrupole (or QQQ) MS system, which includes three quadrupole devices in series. The first quadrupole is utilized for mass selection, the second quadrupole is an RF-only device enclosed in a gas chamber and utilized as the collision cell, and the third quadrupole is utilized as the mass analyzer. Tandem MS may also be implemented in a quadrupole time-of-flight (or qTOF) MS system, the main difference being that the mass analyzer is a TOF analyzer instead of a quadrupole device.

The MS system may include an ion trap configured for storing or accumulating ions prior to transmitting the ions to downstream processes. In particular, an ion trap is capable of scanning (ejecting) the ions out of the ion trap on a mass-selective basis (i.e., according to m/z ratio) using known techniques. Thus an ion trap may also be utilized to sort ions and may be considered as part of a hybrid system similar to a QQQ or qTOF system.

In an ion trap, a radio frequency (RF) voltage on the trap electrodes generates a time-varying electric field in the trap interior that confines ions having a desired range of m/z ratios. Ions of a selected m/z ratio may then be ejected from the trap by known methods such as instability ejection or resonant ejection. When ions are ejected from an ion trap they may exit the trap over a range of phase angles relative to the phase of the main RF trapping voltage. The RF phase at the time of ejection may vary over a range of, for example, sixty degrees.

Correspondingly, the trap instantaneous voltage at the time of ejection may vary from about half of the peak RF voltage down to zero. Ions ejected from the trap, even though they all may have the same m/z ratio, then have that same range of energies relative to any DC reference potential outside of the trap. Ejecting ions over a wide energy distribution may be undesirable when coordinating the ion ejection with downstream processes, such as beam focusing or injection into a collision cell or mass analyzer. In addition to the problem of energy distribution, ions typically are not well collimated when exiting the trap. The typical angular spread of the ejected ions may be too large for many applications. This may especially be true if ion optics lenses are added at the trap output, where changes in divergence from focusing will, in general, interact with the energy distribution of the ions and the rf phase at the time of ion ejection.

Therefore, there is a need for systems, devices and methods for focusing and adjusting the energy of ions ejected from an ion trap.

SUMMARY

To address the foregoing problems, in whole or in part, and/or other problems that may have been observed by persons skilled in the art, the present disclosure provides methods, processes, systems, apparatus, instruments, and/or devices, as described by way of example in implementations set forth below.

According to one embodiment, an ion trap includes: a plurality of trap electrodes spaced from each other and surrounding a trap interior, the trap electrodes configured for generating a RF trapping field in the trap interior and for mass selective ejection of ions from the trap interior, wherein at least one of the electrodes comprises a trap exit, the trap exit comprising an aperture; and a plurality of lenses serially positioned outside the trap interior proximate to the aperture and configured for adjusting a kinetic energy of ions ejected from the trap interior.

According to another embodiment, a mass spectrometry (MS) system includes: the ion trap; and an ion guide downstream of the trap exit.

According to another embodiment, a method for ejecting ions from an ion trap includes: transmitting ions of a selected m/z ratio from a trap interior into a trap exit of the ion trap, wherein the ions exit the trap interior along an ejection axis and at an initial range of kinetic energies; and focusing the ions along the ejection axis and adjusting the kinetic energies of the ions.

According to another embodiment, an ion trap is configured for performing the method of any of the methods disclosed herein.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

Figure 1:
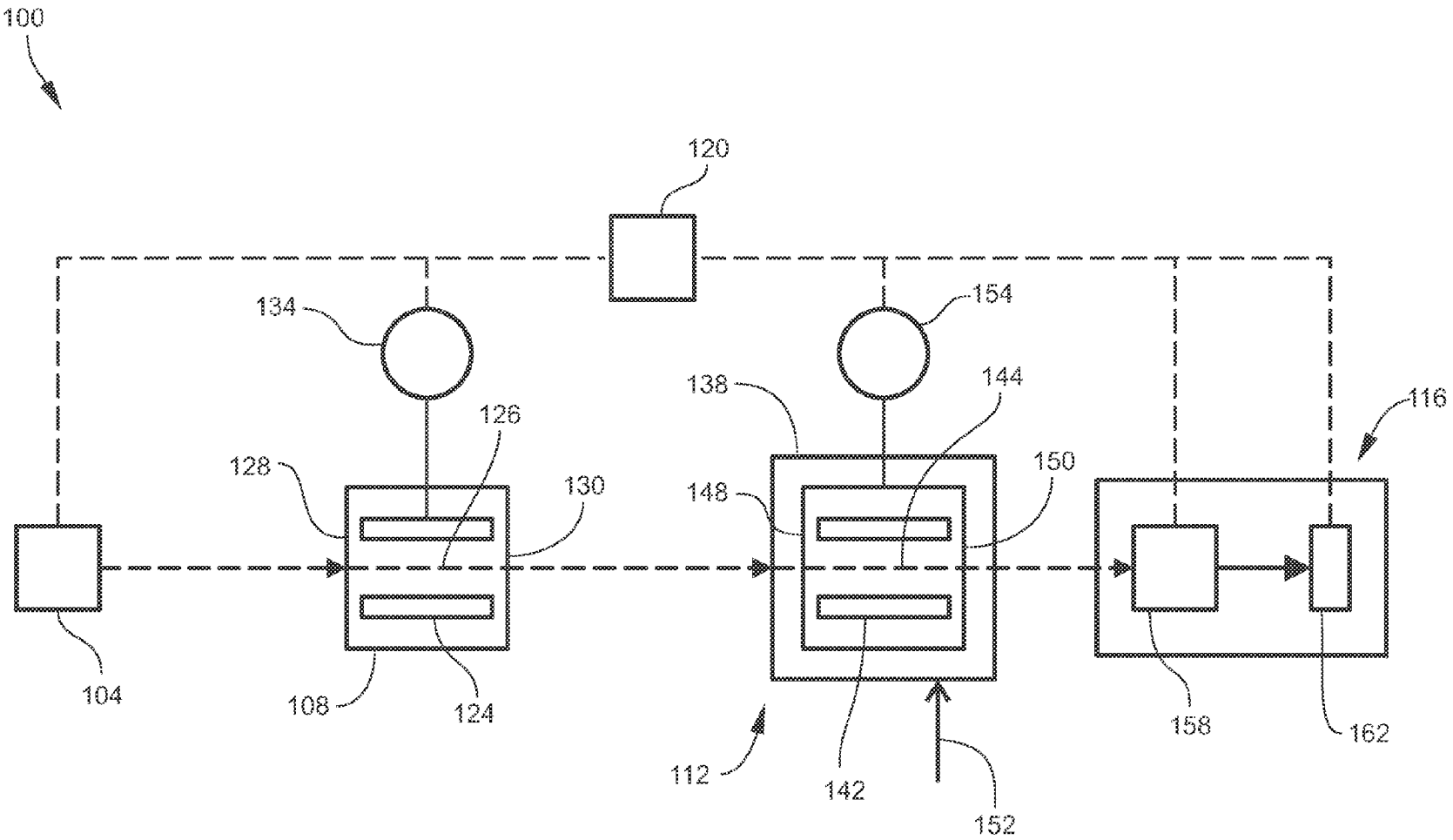
FIG. 1 is a schematic view of an example of a mass spectrometry (MS) system according to some embodiments.

FIG. 1 is a schematic view of an example of a mass spectrometry (MS) system 100 according to some embodiments. The MS system 100 generally includes an ion source 104, an ion trap 108, a mass spectrometer (MS) 116, and a system controller 120. In some embodiments, the MS system 100 includes one or more ion guides 112 and/or other ion processing devices between the ion trap 108 and the mass spectrometer 116.

The ion source 104 may be any type of continuous-beam or pulsed ion source suitable for producing analyte ions for MS operations. Examples of ion sources 104 include, but are not limited to, electrospray ionization (ESI) sources, other atmospheric pressure ionization (API) sources, photo-ionization (PI) sources, electron ionization (EI) sources, chemical ionization (CI) sources, field ionization (FI) sources, plasma or corona discharge sources, laser desorption ionization (LDI) sources, and matrix-assisted laser desorption ionization (MALDI) sources. In some embodiments, the ion source 104 may include two or more ionization devices, which may be of the same type or different type. Depending on the type of ionization implemented, the ion source 104 may reside in a vacuum chamber or may operate at or near atmospheric pressure. Sample material to be analyzed may be introduced to the ion source 104 by any suitable means, including hyphenated techniques in which the sample material is the output of an analytical separation instrument such as, for example, a gas chromatography (GC) or liquid chromatography (LC) instrument (not shown).

The ion trap 108 generally includes a plurality of trap electrodes 124 arranged about a trap axis 126 and surrounding an interior region (trap interior) of the ion trap 108, a trap entrance (or ion entrance) 128 into the interior region, and a trap exit (or ion exit) 130 out from the interior region. The ion trap 108 is enclosed in a vacuum chamber (not shown). The trap electrodes 124 are in signal communication with an appropriate voltage source 134, which includes a radio frequency (RF) voltage source and typically also a direct current (DC) voltage source. In response to applying an RF voltage of appropriate parameters (RF drive frequency and magnitude), and typically also a DC voltage of appropriate magnitude superposed on the RF voltage, the trap electrodes 124 are configured to generate an RF quadrupole trapping field that confines ions of a desired mass range (m/z range) to the trap interior for a desired period of time. The trap electrodes 124 are also configured to scan the trapped ions such that they are ejected from the ion scanning trap 108 on a mass-selective basis. Scanning may be done by scanning (varying) at least one of the trapping voltage parameters. In some embodiments scanning is done by resonant excitation, in which a relatively weak supplementary alternating current (AC) voltage of a certain frequency is applied between two opposing trap electrodes 124. At least one trapping voltage parameter is then scanned until the secular frequency of an ion of selected mass comes into resonance with a frequency that is directly or parametrically driven by the supplemental wave frequency. In this way, the selected ion can gain sufficient energy to overcome the repulsive force imparted by the RF trapping field and exit through the trap exit 130. Scanning may also be done by triple resonant ejection by adding a dipole component to the trapping field and a quadrupole and/or dipole component to the excitation field, as described for example in U.S. Pat. Nos. 5,714,755 and 7,034,293, the entire contents of which are incorporated herein by reference. As appreciated by persons skilled in the art, other ion ejection techniques may alternatively be implemented, such as mass-selective instability as described for example in U.S. Pat. No. 4,540,884, the entire contents of which are incorporated herein by reference.

In some embodiments, the trap electrodes 124 are arranged in a two-dimensional (2D) configuration (or linear configuration). In other embodiments, the trap electrodes 124 may be arranged in a three-dimensional (3D) configuration (not specifically shown). Examples of the structure and operation of 2D and 3D ion traps are described generally, for example, in above-referenced U.S. Pat. No. 7,034,293. Examples of 2D and 3D ion traps are described in the context of the present teachings further below.

The ion guide 112 generally operates to focus and transmit ions. For this purpose, the ion guide 112 may include a plurality of guide electrodes 142 arranged about a guide axis 144 and surrounding an interior region of the ion guide 112, a guide entrance (or ion entrance) 148 into the interior region, and a guide exit (or ion exit) 150 out from the interior region. A voltage source 154 applies an RF voltage or composite RF/DC voltage to the guide electrodes 142 to confine ions along the guide axis 144. DC voltages are also utilized to accelerate the ions from the guide entrance 148 to the guide exit 150. In some embodiments, the ion guide 112 performs other functions such as cooling and/or fragmenting ions. In this case, the guide electrodes 142 may be enclosed in a gas chamber 138. A gas inlet 152 admits a neutral damping or collision gas (e.g., helium, nitrogen, argon, etc.) into the gas chamber 138 to enable thermalization, and in some embodiments to enable ion fragmentation by collision-induced dissociation (CID). The ion guide 112 may thus be configured to output fragment ions, or a mixture of fragment ions and non-fragmented parent ions. In some embodiments, the ion guide 112 may include or be configured to operate as an ion funnel, as appreciated by persons skilled in the art.

The MS 116 may generally include a mass analyzer 158 and an ion detector 162. The mass analyzer 158 may be any device configured for separating, sorting or filtering analyte ions on the basis of their respective m/z ratios. Examples of mass analyzers include, but are not limited to, multipole electrode structures (e.g., quadrupole mass filters, ion traps, etc.), time-of-flight (TOF) analyzers, and ion cyclotron resonance (ICR) traps. In other embodiments another type of analytical separation instrument, such as an ion mobility spectrometer (IMS), may be substituted for the MS 116 (in which case an IMS drift tube may be substituted for the mass analyzer 158) or operate in tandem with the MS 116 to provide an additional dimension to the analysis. The ion detector 162 may be any device configured for collecting and measuring the flux (or current) of mass-discriminated ions outputted from the mass analyzer 158. Examples of ion detectors 162 include, but are not limited to, electron multipliers, photomultipliers, and Faraday cups.

Figure 2:
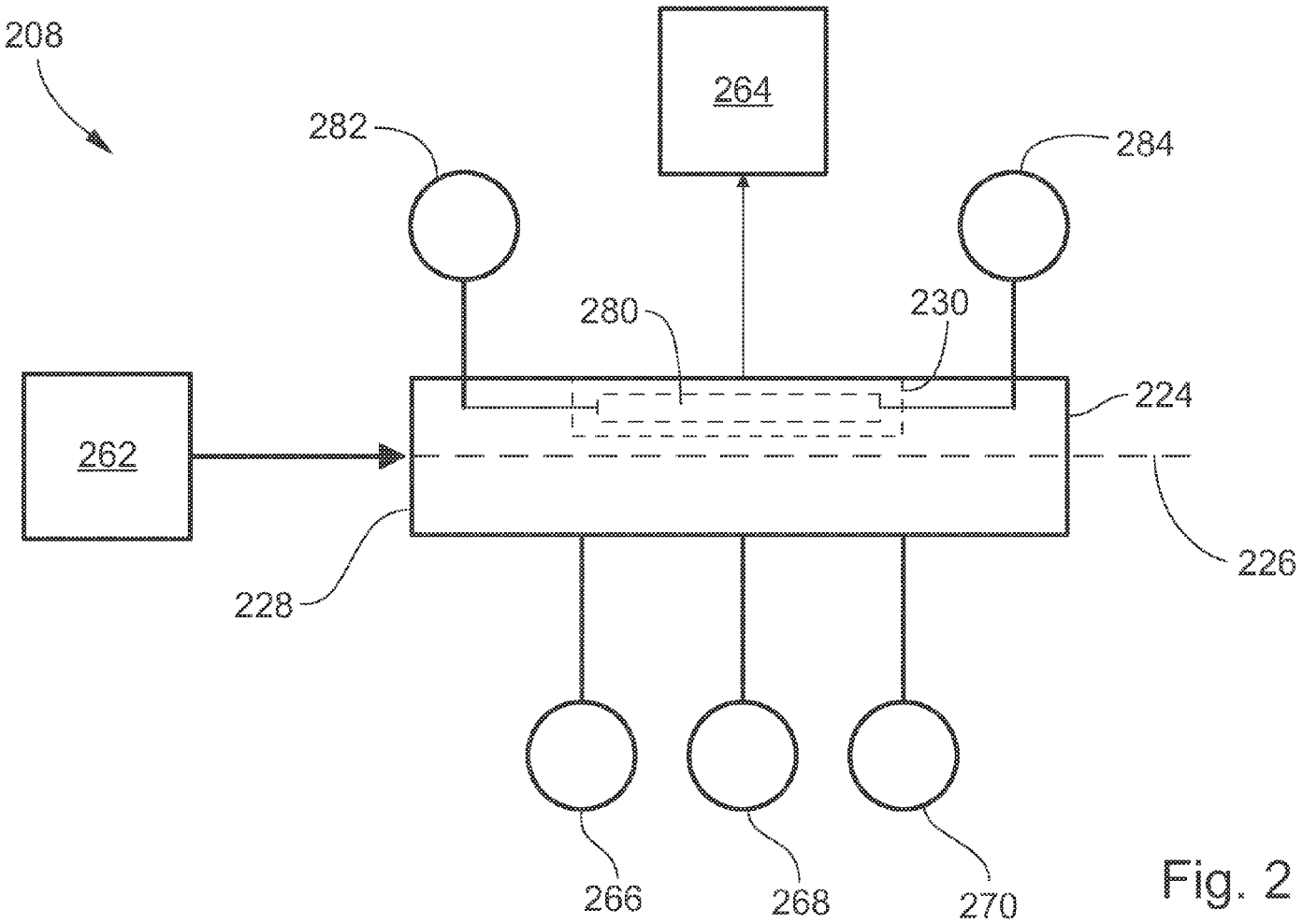
FIG. 2 is a schematic view of an example of a linear ion trap according to some embodiments.
Figure 3:
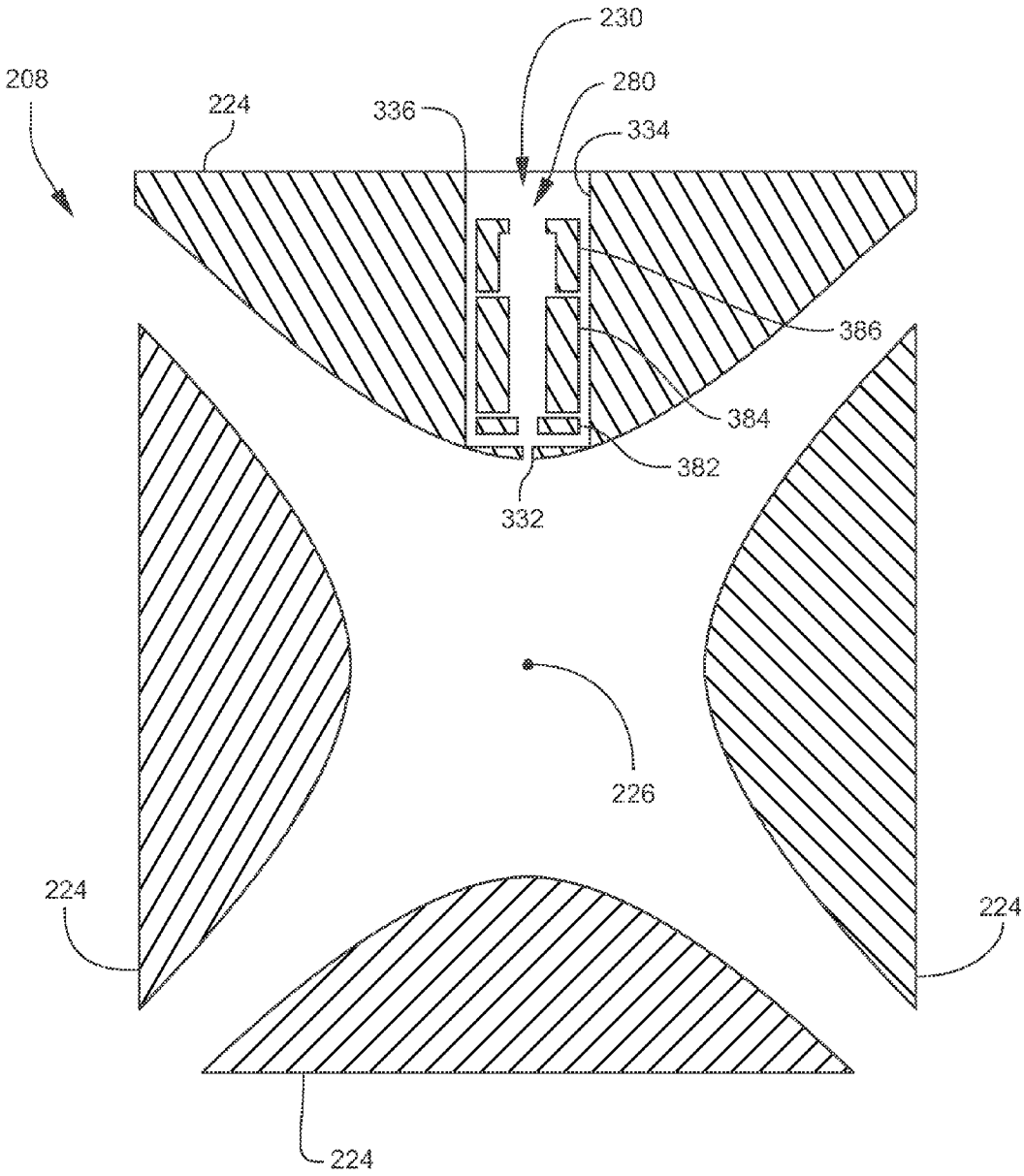
FIG. 3 is a cross-sectional view of the linear ion trap illustrated in FIG. 2.

FIG. 2 is a schematic view of an example of a linear ion trap 208 according to some embodiments. FIG. 3 is a cross-sectional view of the linear ion trap 208, in the transverse plane relative to a trap axis 226. The linear ion trap 208 includes a multipole arrangement of four or more trap electrodes 224 (generally, 2N electrodes where N is an integer equal to 2 or greater) that are parallel to the trap axis 226, elongated in the direction of the trap axis 226, positioned at a radial (transverse) distance from the trap axis 226, and circumferentially spaced from each other about the trap axis 226. As illustrated in FIG. 3, the trap electrodes 224 may include hyperbolic surfaces having foci that face the trap interior. In other embodiments, the trap electrodes 224 may be cylindrical rods or polygonal bars. The linear ion trap 208 includes a trap entrance 228 that may communicate with upstream ion processing devices 262 (e.g., ion source), and a trap exit 230 that may communicate with downstream ion processing devices 264 (e.g., mass analyzer). In the illustrated embodiment, the linear ion trap 208 is configured for transverse (or radial) ejection. In this case, the trap exit 230 may be formed through the body of one of the trap electrodes 224 (the "exit" electrode) to establish a radial ion exit path from the trap interior, through the trap electrode 224 and to the trap exterior. The trap exit 230 may be elongated in the direction of the trap axis 226.

FIG. 2 also schematically illustrates an RF trap voltage source 266 (or RF trapping field signal generator), a DC trap voltage source 268 (or DC signal generator), and an AC supplemental voltage source 270 (or supplemental field generator) in signal communication with the trap electrodes 224. The RF trapping field is typically generated by applying a first RF (or composite RF/DC) voltage to one pair of opposing trap electrodes 224, and a second RF (or composite RF/DC) voltage 180 degrees out of phase with the first RF voltage to at least one other pair of opposing trap electrodes 224. The trapping voltage parameters are set for trapping a desired m/z range of the ions. The trapping voltage parameters may include, for example, drive frequency, peak value of RF voltage magnitude, and DC offset magnitude (the magnitude of a DC component superposed on the main RF voltage). The RF trapping field in this case is a 2D field that limits ion excursion in radial directions relative to the trap axis 226. Ions transmitted through the trap entrance 228 are confined by the RF trapping field to an ion-occupied volume, or ion cloud, in the trap interior, and the ion cloud is elongated along the trap axis 226. The ion cloud may be further reduced by introducing an inert damping gas (e.g., helium, nitrogen, argon, etc.) into the trap interior. DC voltages may be applied to ion optics (not shown) at the axial ends of the ion trap 208 to prevent ions from escaping through the axial ends. Ions may be scanned out from the ion trap 208 according to one of the techniques described earlier in this disclosure. The AC supplemental voltage source 270 may, for example, be utilized for resonant ejection as appreciated by persons skilled in the art. The RF trap voltage source 266, DC trap voltage source 268, and AC supplemental voltage source 270 may be controlled by a controller (e.g., the system controller 120 in FIG. 1).

The ion trap 208 further includes an ion energy adjusting device 280 positioned at the trap exit 230. Generally, the ion energy adjusting device 280 may have any configuration suitable for focusing the ejected ions and adjusting their kinetic energies after they exit the trap interior, and in some embodiments as they travel through the trap exit 230. As described further below, adjustment of ion energy may entail narrowing the range of kinetic energies (reducing the energy distribution) of the ejected ions and/or reducing their average kinetic energy. For such purposes, the ion energy adjusting device 280 may include one or more lenses, one or more of which may be positioned at the trap exit 230 (and in some embodiments in the trap exit 230). FIG. 2 schematically illustrates an RF lens voltage source 282 and a DC lens voltage source 284 in signal communication with the ion energy adjusting device 280. Individual voltages may be applied to respective lenses of the ion energy adjusting device 280. Voltages may be applied to different lenses according to different lens parameters (e.g., RF lens voltage magnitude, RF lens voltage phase relative to RF trap voltage phase, DC offset magnitude). The RF lens voltage source 282 and DC lens voltage source 284 may be controlled by a controller (e.g., the system controller 120 in FIG. 1).

In some embodiments, the trap exit 230 may be shaped so as to include a section of relatively small cross-sectional area directly opening into the trap interior, followed by a section of relatively larger cross-sectional area. For example, as illustrated in FIG. 3 the trap exit 230 may include an inlet aperture 332 that opens into a larger cavity 334, which terminates at an outlet aperture 336 on the side of the trap electrode 224 opposite to the trap interior along the ejection axis. In some embodiments, the ion energy adjusting device 280 may include a first lens 382 axially spaced from the inlet aperture 332, a second lens 384 axially spaced from the first lens 382, and a third lens 386 axially spaced from the second lens 384. One or more of the lenses 382, 384 and 386 may be positioned in the cavity 334. In some embodiments, each of the lenses 382, 384 and 386 may be positioned in the cavity 334, as in the illustrated example. In some embodiments, the third lens 386 may extend outward beyond the outlet aperture 336. In other embodiments, the lenses 382, 384 and 386 may be positioned outside the trap exit 230 yet proximate to the inlet aperture 332. The lenses 382, 384 and 386 may have respective apertures aligned with the inlet aperture 332 along the ejection axis. The lenses 382, 384 and 386 may be individually addressable by the RF lens voltage source 282 and DC lens voltage source 284 for applying different lens voltages to different lenses 382, 384 and 386.

One or more of the lenses (e.g., the first lens 382 in the illustrated example) may be relatively thin lenses. One or more of the lenses (e.g., the second lens 384 in the illustrated example) may be relatively thick lenses. In the present context, and as described further below, generally a "thick lens" has a thickness (length along the ejection axis) great enough that ions exiting the lens encounter an instantaneous RF voltage (magnitude, phase) that is different from the instantaneous RF voltage the ions encountered when they entered the lens, and this difference is sufficiently large as to appreciably shift the ions' energies. In some cases, but not necessarily, all cases, a "thick" lens is one that is greater (and may be substantially greater) than the diameter of the lens' aperture.

In other embodiments, the ion energy adjusting device 280 may include less or more than three lenses.

In other embodiments, the linear ion trap 208 may be configured for axial ejection of ions, in which case the trap exit 230 may correspond to the axial end of the ion trap 208 opposite to the trap entrance 228. In this case, the ion energy adjusting device 280 may be positioned at the end where axial ejection occurs. Axial ion ejection is described generally, for example, in U.S. Pat. No. 6,177,668, the entire contents of which are incorporated herein by reference.

Figure 4:
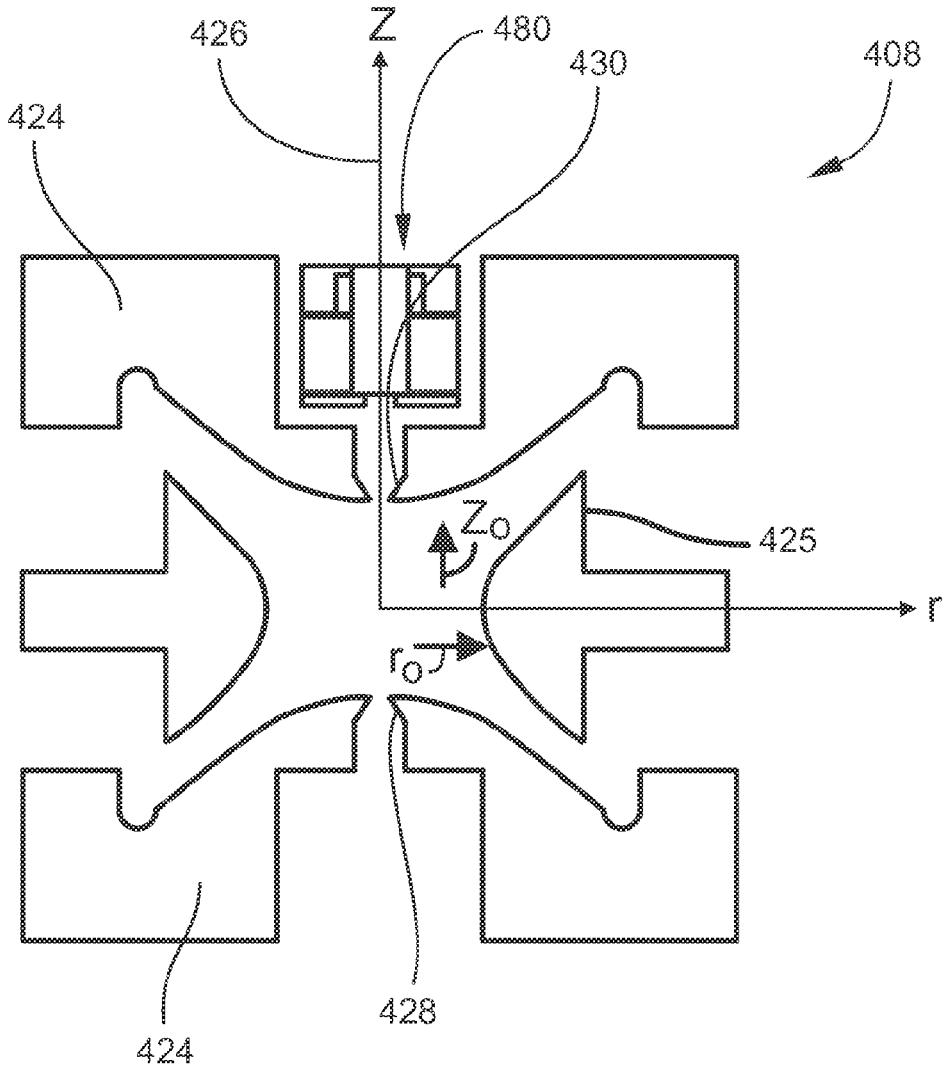
FIG. 4 is a cross-sectional view of an example of a three-dimensional (3D) ion trap according to some embodiments.

FIG. 4 is a cross-sectional view of an example of a 3D ion trap 408 according to some embodiments. In this case, the trap electrodes may include a pair of hyperbolic end-cap electrodes 424 spaced apart from each other along a trap axis 426, and a hyperbolic ring electrode 425 positioned between the end-cap electrodes 424 and coaxially swept about the trap axis 426. The respective foci of the end-cap electrodes 424 face each other and thus face the interior region of the 3D ion trap 408, and the focus of the ring electrode 425 also faces the interior region. An RF trap voltage source, a DC trap voltage source, and optionally an AC supplemental voltage source may be provided as described above. The RF trapping field is typically generated by applying a first RF (or composite RF/DC) voltage to the end-cap electrodes 424, and a second RF (or composite RF/DC) voltage 180 degrees out of phase with the first RF voltage to the ring electrode 425. Application of the RF trapping voltage generates a 3D trapping field that constrains the motion of ions to an ion cloud in the center of the interior region, which may be further reduced by a damping gas. The 3D ion trap 408 includes a trap entrance 428 and trap exit 430, which may be one or more apertures typically formed through the end-cap electrodes 424 (as illustrated) or alternatively formed through the ring electrode 425. An ion energy adjusting device 480 is positioned at the trap exit 430, and may have the same or similar structure and function as the ion energy adjusting device 380 referred to above.

As noted earlier in this disclosure, when ions are ejected from an ion trap, generally they pass through the exit electrode with a range of energies. Ions that have gained just enough energy to exit the ion trap have a kinetic energy approaching zero. Ions will also be ejected if they had just below the threshold of energy required for ejection on their previous orbital pass inside the ion trap but have gained enough energy during that cycle to be now be able to overcome the restoring force imparted by the RF trapping field. Generally the maximum kinetic energy an ion can gain in a single orbit can be related approximately to the time it would take the ion to travel from a trap electrode opposite to the exit electrode, through the trap center, and to the exit electrode in a single RF cycle. IC for example, the distance between the opposite electrodes is 14 mm and the RF cycle time is 1 μs, then it might be expected that the maximum velocity of ions exiting the trap would be approximately 14 mm/μs or 14,000 m/s. Because all ions are ejected using the same RF frequency (for the RF amplitude type of scan) and the dimensions of the ion trap are constant, ions of all masses have the same velocity limits for a given RF frequency and trap geometry.

Figure 5:
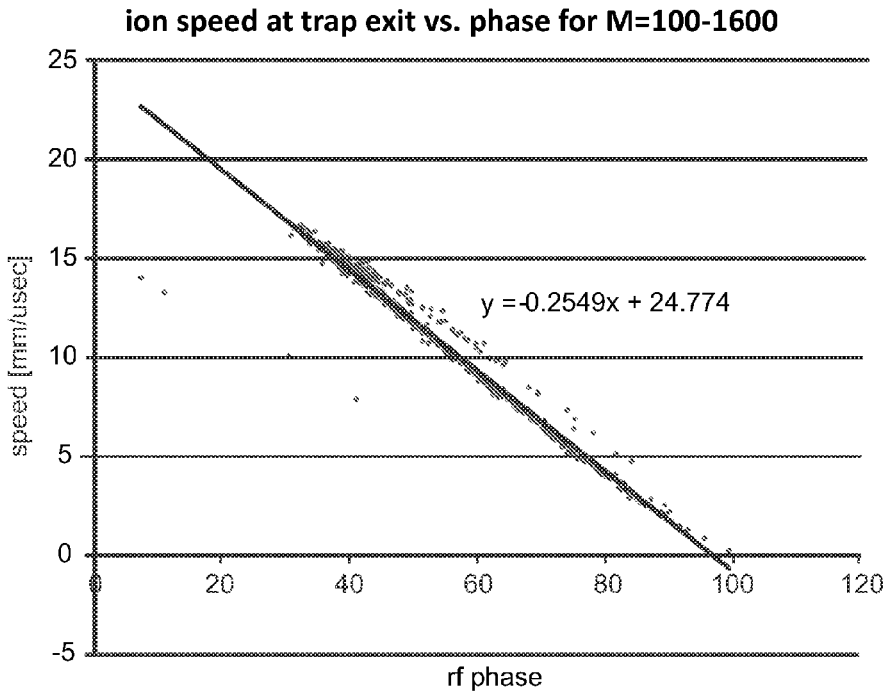
FIG. 5 is a plot of ion velocity (mm/μs) as a function of RF phase (degrees) generated by ion simulation software.
Figure 6:
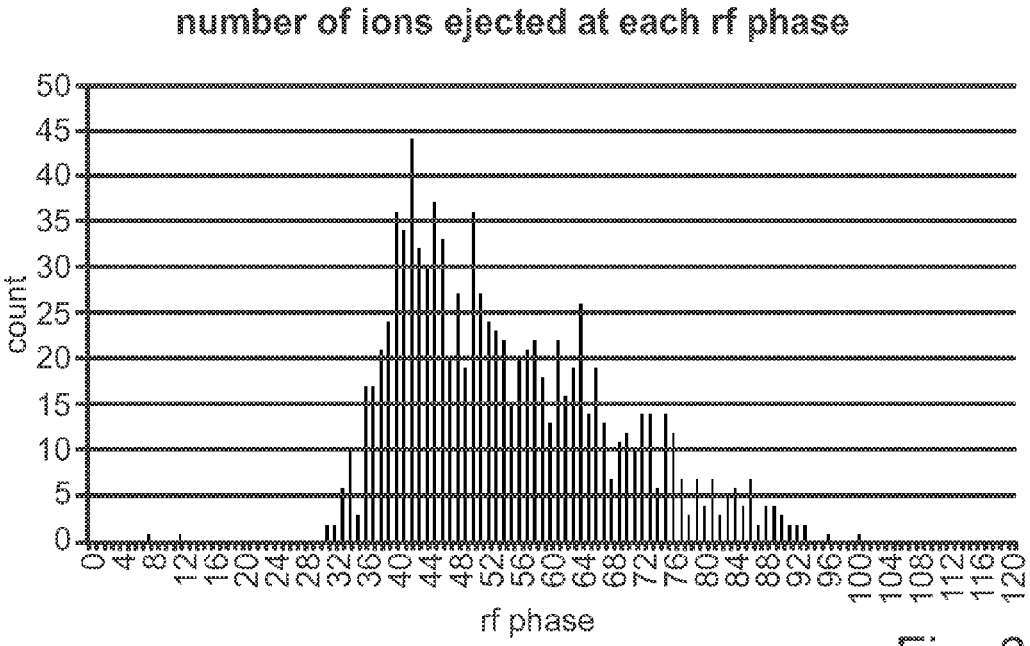
FIG. 6 is a plot of the number of ions ejected at each RF phase from this simulation.
Figure 7:
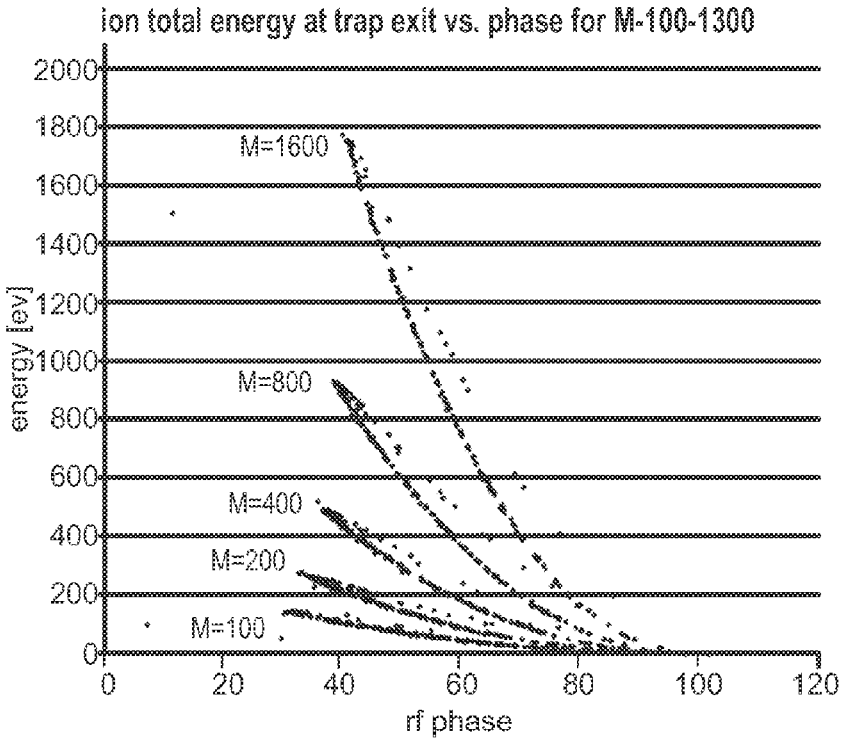
FIG. 7 is a plot of the kinetic energy (eV) of the ions as a function of RF phase from this simulation.
Figure 8:
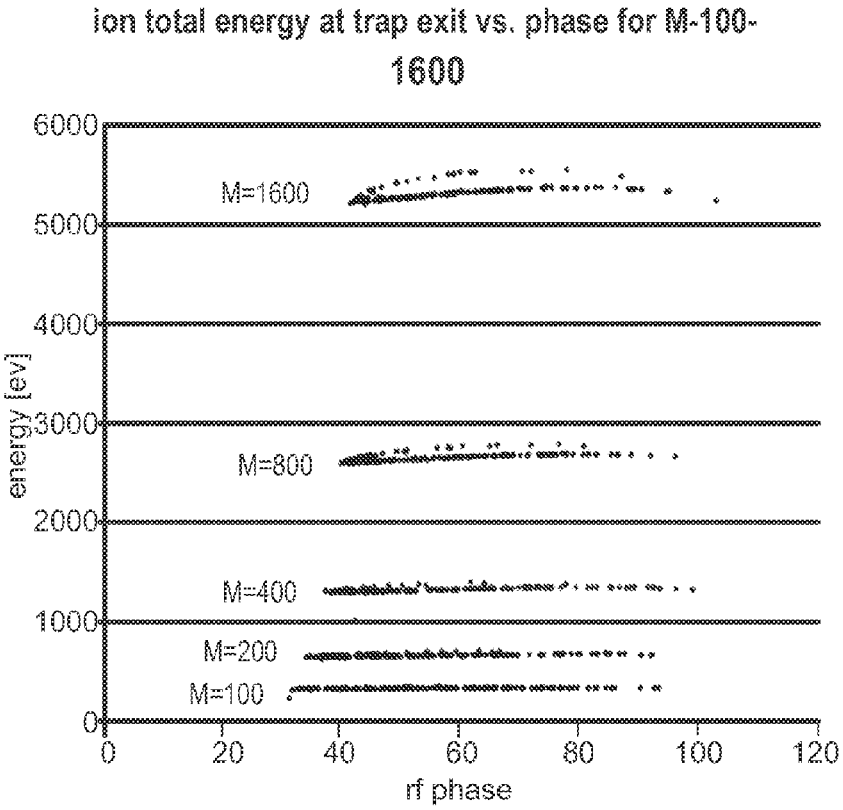
FIG. 8 is a plot of the total ion energy (eV) as a function of RF phase, relative to a zero potential (ground) reference, from this simulation.

In practice, there is also a very strong correlation between the velocity of an ion and the time the ion passes through the trap exit relative to the instantaneous RF phase. This is shown in FIG. 5, which is a plot of ion velocity (mm/μs) as a function of RF phase (degrees) generated by ion simulation software. Ion trajectories were modeled for a linear trap system with a distance between the opposite electrodes of 14 mm and a trap frequency of 1 MHz. The maximum ion velocity as the ions passed through the trap exit was about 17 mm/μs, roughly corresponding to the above approximation. A large majority of the ions of all masses also fall very close to a straight line ($y=-0.2549x+24.774$) at the time of ejection. FIG. 6 is a plot of the number of ions ejected at each RF phase from this simulation. The wide velocity distribution shown in FIG. 5 means that the ejected ions likewise have a wide energy distribution, which is undesirable for many purposes. This is further shown in FIG. 7, which is a plot of the kinetic energy (eV) of the ions as a function of RF phase. Looking, for example, at the distribution of the M=1600 ions, the maximum kinetic energy of some of the M=1600 ions is almost 1800 eV and for other M=1600 ions varies all the way down to near zero. FIG. 7, however, does not account for the voltage potential on the trap electrode, which is also varying with the RF phase. FIG. 8 is a plot of the total ion energy (eV) as a function of RF phase, relative to a zero potential (ground) reference. From the perspective of FIG. 8, the ions for each m/z ratio have a smaller relative energy range. However, the energy range is still large. For example, the different between the highest and lowest energy of the M=1600 ions is greater than 200 eV. This range is far too wide for many uses of the ion trap.

As also noted earlier, ions may exit the ion trap with a less than desirable degree of focusing.

An ion energy adjusting device 280 (or 480) such as described above may be utilized to address the problems of angular and energy spread, by providing a serial arrangement of lenses at the trap exit and applying selected combinations of RF and DC voltages to the respective lenses. Generally, DC voltages of selected amplitudes and polarities, and RF voltages of selected amplitudes and phases relative to the main RF trapping voltage, may be applied at appropriate focal planes (lenses) along the ion ejection path through the trap exit to shift the ions to higher or lower kinetic energies as needed. Because the RF amplitude on the "exit" trap electrode at the time of ejection is linearly related to the mass of the ions being ejected, and because the ion energies for each mass are linearly related to ion mass, the amount of energy shift of the ions may be adjusted as desired for each mass. For each ejection pulse of ions of a given mass, one may determine desirable values for the following lens parameters: magnitude of a DC-only voltage (in a case where no RF is applied), DC offset (magnitude of a DC component superposed on the RF lens voltage), RF amplitude and RF phase (shift) relative to the RF trapping parameters. The RF frequency of the RF lens voltage, however, should be the same as that of the RF trapping voltage. Different voltages (RF-only, RF/DC, DC-only), and/or RF voltages with different lens parameters, may be applied to different lenses as needed. In some embodiments, the last lens of the series may have a DC-only reference potential or be grounded (i.e., a DC potential of zero) to provide a DC-only transition to next device in the MS system.

A given lens of the ion energy adjusting device 280 may be utilized to adjust all ions to have close to the same velocity, and this may be achieved for all ions of all masses (i.e., during any and all mass-selective ejection events). Normalizing the velocity of ejected ions at some point in the trap exit may facilitate applying time-varying voltages to ions in the same way for all ion masses as the ions traverse the rest of the lens system. Generally, a combination of thin lenses and thick lenses may be provided. If a given lens is thin, i.e., the thickness (or axial length) of the lens is not significantly greater than the diameter of its aperture, the energy and velocity shifts will be transient and ions will exit the influence of the thin lens into the electric potential field found on the other side of the thin lens. The ions will have been focused (or collimated) upon entering the thin lens, but will experience different focusing effects upon entering the next region. A thin lens may be utilized to effect a smaller adjustment on the ions as compared to a thick lens. A thin lens may be utilized, for example, to reduce the variance in velocities of ions before they enter a subsequent lens, by increasing the energies of slower ions or decreasing the energies of faster ions. On the other hand, if the lens is a thick lens, ions may emerge from the outlet side with the same velocity but with different potential energies relative to ground. This is because the thickness or length of the thick lens may be such that a significant amount of time passes between the point that ions enter the thick lens and the point that they exit the thick lens. Hence, with an RF voltage applied to the thick lens, the ions encounter significantly different phases of the RF voltage between the time they enter and the time they exit the lens. In typical embodiments, the phase difference between entrance and exit may range from greater than zero to 180 degrees. Thus, ion velocity and lens thickness may be matched such that all ions exit the lens around some desirable phase of the RF cycle. This technique may be employed to shift the ion energies from an initial high value to a more desirable low value, as well as to shift the average ion energy to a lower value. A DC offset of selected amplitude may also be added to complement the RF voltage as needed to obtain the desired result.

As one example, a linear ion trap with an ion energy adjusting device including three lenses L1, L2 and L3, similar to that illustrated in FIG. 3, was modeled using ion simulation software. L1 was a thin lens, L2 was a thick lens, and L3 was a thick lens but not as thick as L2, and the aperture between the trap interior and cavity of the trap exit was thin, again similar to that illustrated in FIG. 3. DC and RF potentials were applied to L1 and L2, and L3 was held at ground. DC offsets, DC slopes (versus ion mass), RF slopes, and RF phases on the L1 and L2 were adjusted to arrange for a minimal ion energy distribution and to target average ion energies of around 50 eV. Ejection events were simulated for five different ion masses. The following TABLE 1 presents one set of results.

TABLE 1

| M | trap RF | avg KE | stdev KE |
|---|---|---|---|
| 100 | 334.33 | 44.59 | 12.57 |
| 200 | 667.58 | 59.55 | 24.50 |
| 400 | 1332.69 | 55.41 | 30.46 |
| 800 | 2661.91 | 67.76 | 51.59 |
| 1600 | 5319.24 | 97.48 | 76.16 |

The first column shows the ion masses ejected, the second column shows the trap RF amplitude at the time of ejection for each ion mass, the third column shows the average kinetic energy relative to grounded L3 for each ion mass, and the fourth column shows the standard deviation of ion energies for each ion mass. Compared to the initial energy data shown in FIGS. 7 and 8, this is a significant improvement.

The results shown were obtained with the following lens parameters:

TABLE 2

| | |
|---|---|
| L1 AC slope | 0.856 |
| L2 AC slope | 0.850 |
| L1 phase (degrees) | 52.6 |
| L2 phase (degrees) | 49.2 |
| L1 DC offset (V) | 39.6 |
| L2 DC offset (V) | −160.8 |
| L1 DC slope | 0.225 |
| L2 DC slope | −0.256 |

Figure 9:
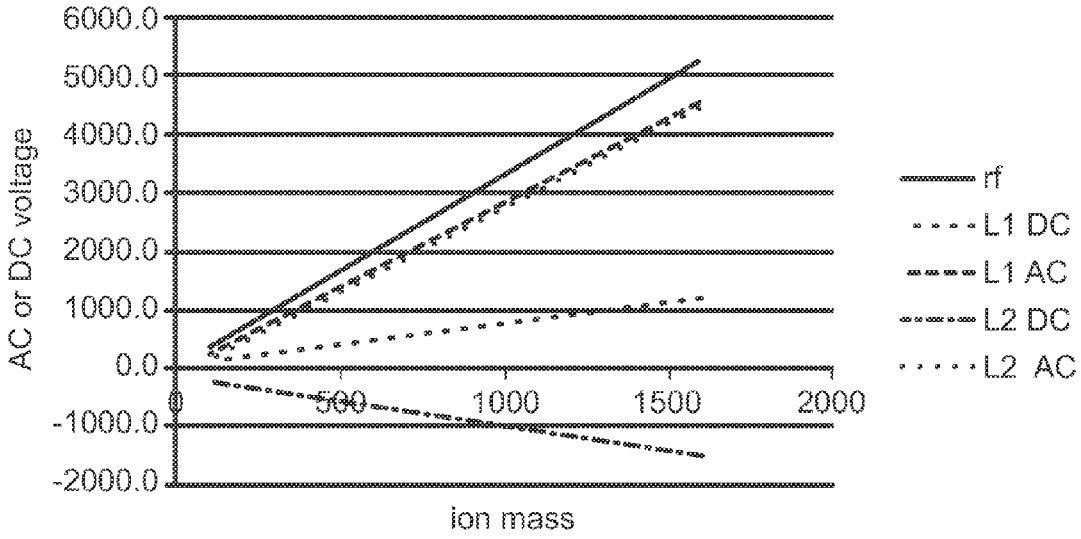
FIG. 9 is a set of plots of voltage magnitude as a function of ion mass applied to trap electrodes and lenses according to a simulation.

These parameters are also plotted in FIG. 9. Note that in FIG. 9 the curve for L1 AC is close to, and thus hidden by, the curve for L2 AC.

EXEMPLARY EMBODIMENTS

Exemplary embodiments provided in accordance with the presently disclosed subject matter include, but are not limited to, the following:

1. An ion trap, comprising: a plurality of trap electrodes spaced from each other and surrounding a trap interior, the trap electrodes configured for generating a RF trapping field in the trap interior and for mass selective ejection of ions from the trap interior, wherein at least one of the electrodes comprises a trap exit, the trap exit comprising an aperture; and a plurality of lenses serially positioned outside the trap interior proximate to the aperture and configured for adjusting a kinetic energy of ions ejected from the trap interior 2. The ion trap of embodiment 1, wherein the trap electrodes have a two-dimensional or three-dimensional geometry.

3. The ion trap of embodiment 1 or 2, wherein the trap electrodes have a geometry selected from the group consisting of: the trap electrodes are circumferentially spaced from each other about a central axis, and the trap electrodes, the trap interior and the trap exit are elongated along the central axis; and the trap electrodes comprise a pair of end caps facing each other on opposite sides of the trap interior along an axis passing through a center of the trap interior, and a ring coaxial with the axis.

4. The ion trap of any of embodiments 1-3, comprising a lens voltage source configured for applying respective voltages to the lenses at respective lens parameters, wherein the lens parameters are selected from the group consisting of: a DC voltage magnitude, a DC offset magnitude superposed on an RF lens voltage, an RF lens voltage magnitude, an RF lens voltage phase, and a combination of two or more of the foregoing.

5. The ion trap of embodiment 4, wherein the lens voltage source is configured for applying the voltage to at least one of the lenses at lens parameters different from the lens parameters of the voltages applied to the other lenses.

6. The ion trap of any of embodiments 1-3, comprising a lens voltage source configured for applying respective voltages to the lenses at respective lens parameters, and for varying the lens parameters according to the m/z ratio of the ejected ions, wherein the lens parameters are selected from the group consisting of: a DC offset magnitude superposed on an RF lens voltage, an RF lens voltage magnitude, and both the DC offset magnitude and the RF lens voltage magnitude.

7. The ion trap of any of embodiments 1-3, comprising a lens voltage source configured for applying an RF/DC voltage to at least one of the lenses, and a zero or nonzero DC voltage to another lens.

8. The ion trap of any of embodiments 1-7, wherein the plurality of lenses comprises a first lens, a second lens, and a third lens, and further comprising a lens voltage source configured for applying a first RF/DC voltage to the first lens, a second RF/DC voltage to the second lens, and a zero or nonzero DC voltage to the third lens.

9. The ion trap of any of embodiments 1-8, wherein the plurality of lenses is configured for adjusting the kinetic energy such that the ejected ions leave the trap exit in a narrowed range of kinetic energies, at a reduced average kinetic energy, or both in a narrowed range of kinetic energies and at a reduced average kinetic energy.

10. The ion trap of any of embodiments 1-9, wherein at least one of the lenses is configured for adjusting the kinetic energy such that the ejected ions leave the at least one lens at substantially the same velocity.

11. The ion trap of any of embodiments 1-10, wherein at least one of the lenses has a thickness and an aperture formed through the thickness, and the thickness is substantially greater than a diameter of the aperture.

12. The ion trap of embodiment 11, wherein at least one of the lenses is a thick lens configured for applying an RF confining field to ejected ions passing therethrough, and the thick lens has a thickness selected such that the ejected ions entering the thick lens experience the RF confining field at a first RF voltage phase, and the ejected ions exiting the thick lens experience the RF confining field at a second RF voltage phase differing from the first RF voltage phase.

13. A mass spectrometry (MS) system, comprising: the ion trap of any of embodiments 1-12; and an ion guide downstream of the trap exit.

14. The MS system of embodiment 13, wherein the ion guide is selected from the group consisting of an ion optics device, an ion funnel, a collision cell, and a mass analyzer.

15. A method for ejecting ions from an ion trap, the method comprising: transmitting ions of a selected m/z ratio from a trap interior into a trap exit of the ion trap, wherein the ions exit the trap interior along an ejection axis and at an initial range of kinetic energies; and focusing the ions along the ejection axis and adjusting the kinetic energies of the ions.

16. The method of embodiment 15, wherein adjusting the kinetic energies comprises making an adjustment selected from the group consisting of: adjusting the kinetic energies while the ions travel through the trap exit; adjusting the initial range of kinetic energies to a narrower final range of kinetic energies at which the ion leave the trap exit; reducing an average kinetic energy of the ions; and a combination of two or more of the foregoing.

17. The method of embodiment 15, wherein adjusting the kinetic energies comprises narrowing the initial range of kinetic energies to a final range of kinetic energies at which the ion leave the trap exit, and narrowing comprises accelerating ions of lower kinetic energy relative to the other ions, decelerating ions of higher kinetic energy relative to the other ions, or both accelerating ions of lower kinetic energy and decelerating ions of higher kinetic energy.

18. The method of any of embodiments 15-17, wherein adjusting the kinetic energies comprises adjusting the ions to all have substantially the same velocity at a point along a length of the trap exit.

19. The method of any of embodiments 15-18, wherein the ion trap comprises a plurality of lenses positioned in the trap exit in series along the ejection axis, and adjusting the kinetic energies comprises applying lens voltages to the respective lenses.

20. The method of embodiment 19, wherein applying the lens voltages makes an adjustment selected from the group consisting of: adjusting the initial range of kinetic energies to a narrower final range of kinetic energies at which the ion leave the trap exit; reducing an average kinetic energy of the ions; and both adjusting the initial range and reducing the average kinetic energy.

21. The method of embodiment 19 or 20, wherein at least one of the lens voltages applied is an RF voltage or a composite RF/DC voltage.

22. The method of any of embodiments 19-21, wherein the lens voltages are applied at respective lens parameters selected from the group consisting of: a DC voltage magnitude, a DC offset magnitude superposed on an RF lens voltage, an RF lens voltage magnitude, an RF lens voltage phase, and a combination of two or more of the foregoing.

23. The method of embodiment 22, wherein at least one of the lens voltages is applied to the corresponding lens at lens parameters different from the lens parameters of the voltages applied to the other lenses.

24. The method of embodiment 19, wherein the lens voltages are applied at respective lens parameters, and further comprising selecting values of one or more of the lens parameters according to the m/z ratio of the ejected ions, wherein the lens parameters are selected from the group consisting of: a DC offset magnitude superposed on an RF lens voltage, an RF lens voltage magnitude, and both the DC offset magnitude and the RF lens voltage magnitude.

25. The method of any of embodiments 19-24, wherein the plurality of lenses comprises a first lens, a second lens, and a third lens, and applying the lens voltages comprises applying a first RF/DC voltage to the first lens, a second RF/DC voltage to the second lens, and a zero or nonzero DC voltage to the third lens.

26. The method of any of embodiments 19-25, wherein at least one of the lenses is a thick lens having an aperture diameter and a thickness greater than the aperture diameter, and adjusting the kinetic energies comprises applying an RF lens voltage to the thick lens such that the ions upon entering the thick lens experience the RF lens voltage at a first phase, and the ions upon exiting the thick lens experience the RF lens voltage at a second phase differing from the first phase.

27. The method of embodiment 26, wherein adjusting the kinetic energies comprises transmitting the ions into the thick lens at substantially the same velocity, and selecting the velocity such that the ions upon exiting the thick lens experience the RF lens voltage at a desired value of the second phase.

28. An ion trap configured for performing the method of any of embodiments 15-27.

The system controller 120 is schematically depicted in FIG. 1 as representing one or more modules configured for controlling, monitoring and/or timing various functional aspects of the MS system 100 such as, for example, controlling the operation of the ion source 104; controlling the application of voltages to the ion trap 108 and setting and adjusting the voltage parameters for loading, storing and scanning out ions; controlling the application of voltages to the ion guide 112 and controlling any additional functions provided such as gas flow; controlling any ion optics (not shown) provided between the illustrated components; and controlling vacuum pumps (not shown). The system controller 120 may also be configured for controlling the application of voltages to an ion energy adjustment device (e.g., 280 or 480) as described above. The system controller 120 may also be configured for receiving the ion detection signals from the ion detector 162 and performing other tasks relating to data acquisition and signal analysis as necessary to generate a mass spectrum characterizing the sample under analysis. The system controller 120 may include a computer-readable medium that includes instructions for performing any of the methods disclosed herein. For all such purposes, the system controller 120 is schematically illustrated as being in signal communication with various components of the MS system 100 via wired or wireless communication links represented by dashed lines. Also for these purposes, the system controller 120 may include one or more types of hardware, firmware and/or software, as well as one or more memories and databases. The system controller 120 typically includes a main electronic processor providing overall control, and may include one or more electronic processors configured for dedicated control operations or specific signal processing tasks. The system controller 120 may also schematically represent all voltage sources not specifically shown, as well as timing controllers, clocks, frequency/waveform generators and the like as needed for applying voltages to various components of the MS system 100. The system controller 120 may also be representative of one or more types of user interface devices, such as user input devices (e.g., keypad, touch screen, mouse, and the like), user output devices (e.g., display screen, printer, visual indicators or alerts, audible indicators or alerts, and the like), a graphical user interface (GUI) controlled by software, and devices for loading media readable by the electronic processor (e.g., logic instructions embodied in software, data, and the like). The system controller 120 may include an operating system (e.g., Microsoft Windows® software) for controlling and managing various functions of the system controller 120.

It will be understood that the term "in signal communication" as used herein means that two or more systems, devices, components, modules, or sub-modules are capable of communicating with each other via signals that travel over some type of signal path. The signals may be communication, power, data, or energy signals, which may communicate information, power, or energy from a first system, device, component, module, or sub-module to a second system, device, component, module, or sub-module along a signal path between the first and second system, device, component, module, or sub-module. The signal paths may include physical, electrical, magnetic, electromagnetic, electrochemical, optical, wired, or wireless connections. The signal paths may also include additional systems, devices, components, modules, or sub-modules between the first and second system, device, component, module, or sub-module.

More generally, terms such as "communicate" and "in . . . communication with" (for example, a first component "communicates with" or "is in communication with" a second component) are used herein to indicate a structural, functional, mechanical, electrical, signal, optical, magnetic, electromagnetic, ionic or fluidic relationship between two or more components or elements. As such, the fact that one component is said to communicate with a second component is not intended to exclude the possibility that additional components may be present between, and/or operatively associated or engaged with, the first and second components.

It will be understood that various aspects or details of the invention may be changed without departing from the scope of the invention. Furthermore, the foregoing description is for the purpose of illustration only, and not for the purpose of limitation—the invention being defined by the claims.

What is claimed is:

1. An ion trap, comprising:

a plurality of trap electrodes spaced from each other and surrounding a trap interior, the trap electrodes configured for generating a RF trapping field in the trap interior and for mass selective ejection of ions from the trap interior, wherein at least one of the electrodes comprises a trap exit, the trap exit comprising an aperture; and a plurality of lenses serially positioned outside the trap interior proximate to the aperture and configured for adjusting a kinetic energy of ions ejected from the trap interior.

2. The ion trap of claim 1, comprising a lens voltage source configured for applying respective voltages to the lenses at respective lens parameters, wherein the lens parameters are selected from the group consisting of: a DC-only voltage magnitude, a magnitude of a DC component superposed on an RF lens voltage, an RF lens voltage magnitude, an RF lens voltage phase, and a combination of two or more of the foregoing.

3. The ion trap of claim 1, wherein the trap exit comprises a cavity and one or more of the lenses are positioned in the cavity.

4. The ion trap of claim 1, comprising a lens voltage source configured for applying respective voltages to the lenses at respective lens parameters, and for varying the lens parameters according to the m/z ratio of the ejected ions, wherein the lens parameters are selected from the group consisting of: a magnitude of a DC component superposed on an RF lens voltage, an RF lens voltage magnitude, and both of the foregoing.

5. The ion trap of claim 1, comprising a lens voltage source configured for applying an RF/DC voltage to at least one of the lenses, and a zero or nonzero DC voltage to another lens.

6. The ion trap of claim 1, wherein the plurality of lenses is configured for adjusting the kinetic energy such that the ejected ions leave the trap exit in a narrowed range of kinetic energies, at a reduced average kinetic energy, or both in a narrowed range of kinetic energies and at a reduced average kinetic energy.

7. The ion trap of claim 1, wherein at least one of the lenses is configured for adjusting the kinetic energy such that the ejected ions leave the at least one lens at substantially the same velocity.

8. The ion trap of claim 1, wherein at least one of the lenses is a thick lens.

9. A method for ejecting ions from an ion trap, the method comprising:

transmitting ions of a selected m/z ratio from a trap interior into a trap exit of the ion trap, wherein the ions exit the trap interior along an ejection axis and at an initial range of kinetic energies; and focusing the ions along the ejection axis and adjusting the kinetic energies of the ions.

10. The method of claim 9, wherein adjusting the kinetic energies comprises making an adjustment selected from the group consisting of: adjusting the kinetic energies while the ions travel through the trap exit; adjusting the initial range of kinetic energies to a narrower final range of kinetic energies at which the ion leave the trap exit; reducing an average kinetic energy of the ions; and a combination of two or more of the foregoing.

11. The method of claim 9, wherein adjusting the kinetic energies comprises narrowing the initial range of kinetic energies to a final range of kinetic energies at which the ion leave the trap exit, and narrowing comprises accelerating ions of lower kinetic energy relative to the other ions, decelerating ions of higher kinetic energy relative to the other ions, or both accelerating ions of lower kinetic energy and decelerating ions of higher kinetic energy.

12. The method of claim 9, wherein adjusting the kinetic energies comprises adjusting the ions to all have substantially the same velocity at a point along a length of the trap exit.

13. The method of claim 9, wherein the ion trap comprises a plurality of lenses positioned in the trap exit in series along the ejection axis, and adjusting the kinetic energies comprises applying lens voltages to the respective lenses.

14. The method of claim 13, wherein at least one of the lens voltages applied is an RF voltage or a composite RF/DC voltage.

15. The method of claim 13, wherein the lens voltages are applied at respective lens parameters selected from the group consisting of: a DC-only voltage magnitude, a magnitude of a DC component superposed on an RF lens voltage, an RF lens voltage magnitude, an RF lens voltage phase, and a combination of two or more of the foregoing.

16. The method of claim 15, wherein at least one of the lens voltages is applied to the corresponding lens at lens parameters different from the lens parameters of the voltages applied to the other lenses.

17. The method of claim 13, wherein the lens voltages are applied at respective lens parameters, and further comprising selecting values of one or more of the lens parameters according to the m/z ratio of the ejected ions, wherein the lens parameters are selected from the group consisting of: a magnitude of a DC component superposed on an RF lens voltage, an RF lens voltage magnitude, and both of the foregoing.

18. The method of claim 13, wherein the plurality of lenses comprises a first lens, a second lens, and a third lens, and applying the lens voltages comprises applying a first RF/DC voltage to the first lens, a second RF/DC voltage to the second lens, and a zero or nonzero DC voltage to the third lens.

19. The method of claim 13, wherein at least one of the lenses is a thick lens having an aperture diameter and a thickness greater than the aperture diameter, and adjusting the kinetic energies comprises applying an RF lens voltage to the thick lens such that the ions upon entering the thick lens experience the RF lens voltage at a first phase, and the ions upon exiting the thick lens experience the RF lens voltage at a second phase differing from the first phase.

20. The method of claim 19, wherein adjusting the kinetic energies comprises transmitting the ions into the thick lens at substantially the same velocity, and selecting the velocity such that the ions upon exiting the thick lens experience the RF lens voltage at a desired value of the second phase.

* * * * *